US010340666B2

(12) United States Patent
Igarashi

(10) Patent No.: US 10,340,666 B2
(45) Date of Patent: Jul. 2, 2019

(54) SPARK PLUG

(71) Applicant: NGK SPARK PLUG CO., LTD., Nagoya-shi, Aichi (JP)

(72) Inventor: Tomoyuki Igarashi, Aichi (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/444,857

(22) Filed: Feb. 28, 2017

(65) Prior Publication Data

US 2017/0256916 A1 Sep. 7, 2017

(30) Foreign Application Priority Data

Mar. 4, 2016 (JP) ..... 2016-042177

(51) Int. Cl.
*H01T 13/32* (2006.01)
*H01T 13/39* (2006.01)

(52) U.S. Cl.
CPC ..... *H01T 13/32* (2013.01); *H01T 13/39* (2013.01)

(58) Field of Classification Search
CPC ..... H01T 13/32; H01T 13/39
See application file for complete search history.

(56) References Cited

U.S. PATENT DOCUMENTS

2004/0100178 A1* 5/2004 Kanao ..... H01T 13/39 313/141
2010/0084391 A1* 4/2010 Nakayama ..... H01T 13/32 219/270
2010/0213812 A1* 8/2010 Kawashima ..... B23K 9/0026 313/141
2010/0275869 A1* 11/2010 Musasa ..... C22C 1/0466 123/169 EL
2011/0193469 A1* 8/2011 Katsuraya ..... H01T 13/32 313/141
2013/0088139 A1* 4/2013 Yoshimoto ..... C22C 19/05 313/141
2014/0265816 A1 9/2014 Hanashi et al. ..... 313/141

FOREIGN PATENT DOCUMENTS

EP 3089289 A1 11/2016 ..... H01T 13/20
JP 2004-152682 A 5/2004
JP 2004-172053 A 6/2004
JP 2008-270188 A 11/2008 ..... H01T 13/20
JP 2010-170705 A 8/2010
JP 2015-125879 A 7/2015 ..... H01T 13/20

OTHER PUBLICATIONS

Extended European Search Report issued in corresponding European Patent Application No. 17159177.9, dated Jun. 21, 2017.
Office Action received in the corresponding Japanese Patent Application No. 2016-042177, dated Dec. 26, 2017.

* cited by examiner

*Primary Examiner* — Kevin Quarterman
(74) *Attorney, Agent, or Firm* — Kusner & Jaffe

(57) ABSTRACT

A spark plug having a noble metal tip that is joined to a tip-joining surface of a ground electrode so as to face an end face of a center electrode. When the noble metal tip is projected onto a projection plane parallel to the tip-joining surface, the noble metal tip has an elliptical shape in the projection plane. When the ground electrode is also projected onto the projection plane, an angle of 45° or less is formed between the major axis of the elliptical shape in the projection plane and a straight line extending in the lengthwise direction of the ground electrode and passing through the center of the noble metal tip in the projection plane.

9 Claims, 7 Drawing Sheets

SPARK PLUG

RELATED APPLICATIONS

This application claims the benefit of Japanese Patent Application No. 2016-042177, filed Mar. 4, 2016.

FIELD OF THE INVENTION

The present invention relates to a spark plug.

BACKGROUND OF THE INVENTION

In one widely used conventional spark plug, a noble metal tip protruding toward a center electrode is disposed on a ground electrode. For example, in a spark plug described in Japanese Patent Application Laid-Open (kokai) No. 2015-125879, a cuboidal noble metal tip is disposed on a ground electrode. In a spark plug described in Japanese Patent Application Laid-Open (kokai) No. 2008-270188, an elliptic cylindrical noble metal tip is disposed on a ground electrode. A noble metal tip having any of these shapes can easily have a larger volume than a cylindrical (circular cylindrical) noble metal tip, and the spark plug can therefore have improved durability.

In the spark plug in Japanese Patent Application Laid-Open (kokai) No. 2015-125879, the noble metal tip has a cuboidal shape, and the spark plug can therefore have improved durability. However, since the surface area of this noble metal tip is larger than that of a cylindrical noble metal tip with the same volume as the above noble metal tip, its quenching action is likely to be stronger, and this may lower the ignition performance of the spark plug. In the spark plug disclosed in Japanese Patent Application Laid-Open (kokai) No. 2008-270188, the noble metal tip has an elliptic cylindrical shape, and the spark plug can therefore have improved durability. However, since the minor axis direction of the noble metal tip that is a direction in which a flame core can easily expand extends along the lengthwise direction of the ground electrode, the expansion of the flame core is likely to be impeded by a base end portion of the ground electrode, and this may lower the ignition performance of the spark plug. Therefore, in a spark plug in which a noble metal tip protruding toward a center electrode is disposed on a ground electrode, there is a need for a technique that improves the ignition performance of the spark plug while ensuring the durability of the spark plug.

The present invention has been made to address the above problem and can be embodied in the following modes.

SUMMARY OF THE INVENTION (1) According to a first aspect of the present invention there is provided a spark plug. The spark plug comprises an insulator having an axial hole extending along an axial line; a center electrode disposed within the axial hole; a tubular metallic shell disposed around an outer circumference of the insulator; and a ground electrode having a tip-joining surface and a base end that is fixed to the metallic shell. The ground electrode includes a noble metal tip that is joined to the tip-joining surface so as to face an end face of the center electrode and to protrude toward the end face, wherein, when the noble metal tip is projected onto a projection plane parallel to the tip-joining surface, the noble metal tip has an elliptical shape in the projection plane, and wherein, when the ground electrode is also projected onto the projection plane, an angle of 45° or less is formed between a major axis of the elliptical shape in the projection plane and a straight line extending in a lengthwise direction of the ground electrode and passing through a center of the noble metal tip in the projection plane. In the spark plug described above, the noble metal tip has an elliptic cylindrical shape, and its minor axis does not extend in the lengthwise direction of the ground electrode. Therefore, while the durability of the spark plug is ensured, its ignition performance can be improved.

(2) in accordance with a second aspect of the present invention, there is provided a spark plug as described above, wherein the noble metal tip may have a volume of 0.15 $mm^3$ or more. In this case, the possibility of the occurrence of misfiring is lower than that when a noble metal tip having a shape other than the elliptic cylindrical shape is used.

(3) In accordance with a third aspect of the present invention, there is provided a spark plug as described above, wherein, in the projection plane, the ratio R of a major diameter of the elliptical shape to a minor diameter of the elliptical shape may be greater than 1.0 and less than 1.1. In this case, the joint strength of the noble metal tip joined to the ground electrode can be increased.

(4) in accordance with a fourth aspect of the present invention, there is provided a spark plug as described above, further comprising an intermediate tip joined between the noble metal tip and the ground electrode. In this case, the joint strength of the noble metal tip joined to the ground electrode can be increased.

(5) In accordance with a fifth aspect of the present invention, there is provided a spark plug as described above, wherein the distance between the noble metal tip and the center electrode may be 1.3 mm or less. In this case, the possibility of the occurrence of misfiring is lower than that when a noble metal tip having a shape other than the elliptical shape is used.

(6) In accordance with a sixth aspect of the present invention, there is provided a spark plug as described above, wherein, in the projection plane, the major axis may be located between two straight lines connecting a center of the elliptical shape to two corners of the base end that are on a side closer to the noble metal tip. In this case, it is possible to effectively prevent the expansion of the flame core from being impeded by the base end of the ground electrode.

(7) In accordance with a seventh aspect of the present invention, there is provided a spark plug as described above, wherein the major diameter of the noble metal tip may be smaller than a diameter of the end face of the center electrode. In this case, it is possible to effectively prevent the expansion of the flame core from being impeded by the noble metal tip.

The present invention can be embodied in various forms other than the spark plug described above. For example, the present invention can be embodied in the form of a method of manufacturing the spark plug.

DETAILED DESCRIPTION OF THE PREFERRED EMBODIMENTS

A. First Embodiment

Figure 1:
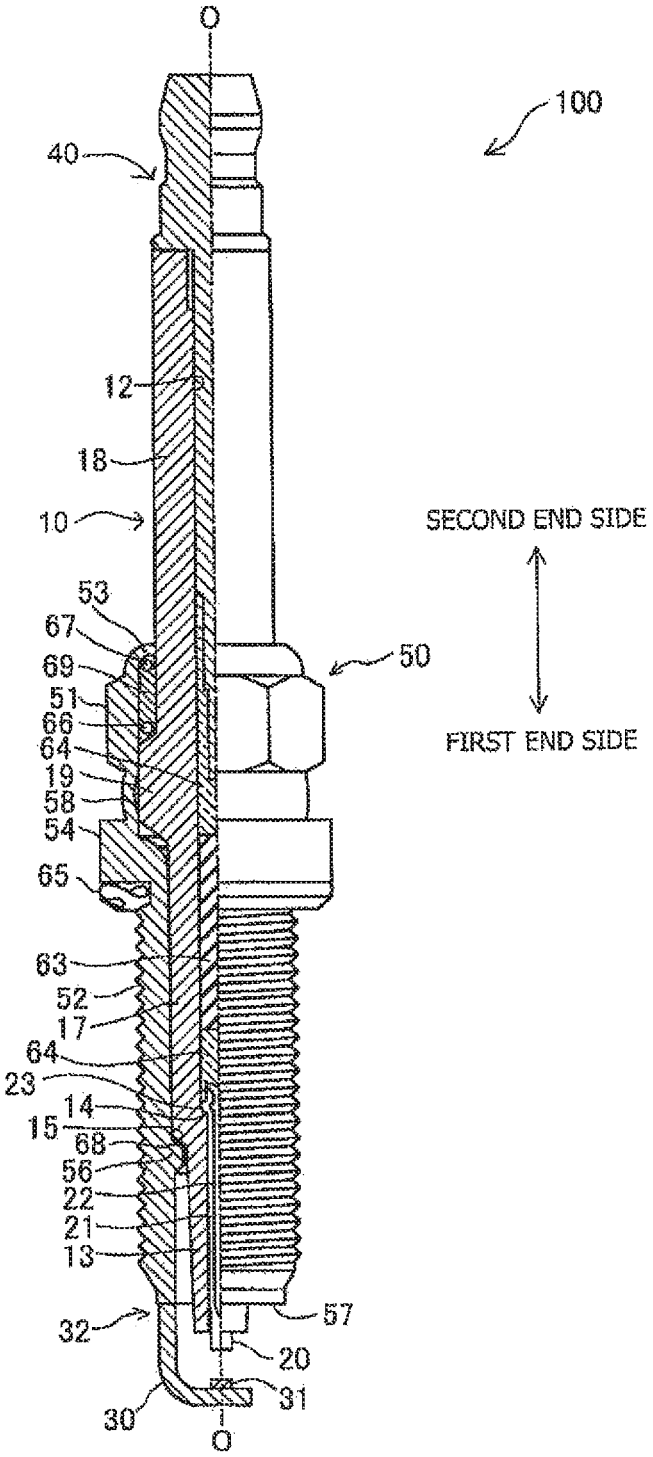
FIG. 1 is a partial cross-sectional view of a spark plug according to a first embodiment of the present invention.

FIG. 1 is a partial cross-sectional view of a spark plug 100 according to a first embodiment of the present invention. The spark plug 100 has an elongated shape extending along an axial line O. In FIG. 1, the right side of the axial line O denoted by a dot-dash line is an external front view of the spark plug 100, and the left side of the axial line O is a cross-sectional view passing through the axial line O. In the following description, the lower side in FIG. 1 is referred to as a first end side of the spark plug 100, and the upper side in FIG. 1 is referred to as a second end side of the spark plug 100.

The spark plug 100 includes: an insulator 10 having an axial hole 12 extending along the axial line O; a center electrode 20 disposed within the axial hole 12; a tubular metallic shell 50 disposed around the outer circumference of the insulator 10; and a ground electrode 30 having a base end 32 fixed to the metallic shell 50.

The insulator 10 is a ceramic insulator formed by firing a ceramic material such as alumina. The insulator 10 is a tubular member having the axial hole 12 formed at its center. Part of the center electrode 20 is inserted into a first end portion of the axial hole 12, and part of a metallic terminal 40 is inserted into a second end portion of the axial hole 12. A central trunk portion 19 having a large outer diameter is formed in an axial central portion of the insulator 10. A second end-side trunk portion 18 having a smaller outer diameter than the central trunk portion 19 is formed on the second end side of the central trunk portion 19. A first end-side trunk portion 17 having a smaller outer diameter than the second end-side trunk portion 18 is formed on the first end side of the central trunk portion 19. A leg portion 13 is formed at a first end of the first end-side trunk portion 17. The outer diameter of the leg portion 13 is smaller than that of the first end-side trunk portion 17 and decreases toward the center electrode 20.

The metallic shell 50 is a cylindrical metallic member that surrounds and holds a portion of the insulator 10 that extends from part of the second end-side trunk portion 18 to the leg portion 13. The metallic shell 50 is formed of, for example, low carbon steel. The entire metallic shell 50 is plated by, for example, nickel plating or zinc plating. The metallic shell 50 includes a tool engagement portion 51, a seal portion 54, and a mounting screw portion 52 in this order from the second end side. A tool for mounting the spark plug 100 to an engine head is to be fitted to the tool engagement portion 51. The mounting screw portion 52 has a thread to be screwed into a mounting screw hole of the engine head. The seal portion 54 has a flange shape and is formed at a base portion of the mounting screw portion 52. An annular gasket 65 formed by bending a plate is to be inserted between the seal portion 54 and the engine head. An end face 57 of the metallic shell 50 at the first end has a hollow circular shape, and the first end of the leg portion 13 of the insulator 10 and the first end of the center electrode 20 protrude from the center of the end face 57.

The metallic shell 50 has a thin crimp portion 53 extending from the second end of the tool engagement portion 51. A compression deformable portion 58 which is thin like the thin crimp portion 53 is disposed between the seal portion 54 and the tool engagement portion 51. Annular ring members 66 and 67 are interposed between the inner circumferential surface of the metallic shell 50 and the outer circumferential surface of the second end-side trunk portion 18 of the insulator 10 such that they are located in a region extending from the tool engagement portion 51 to the crimp portion 53. The space between the ring members 66 and 67 is filled with powder of talc 69. When the spark plug 100 is produced, the crimp portion 53 is bent inward and pressed toward the first end side, and the compression deformable portion 58 is thereby compressed and deformed. As a result of the compressive deformation of the compression deformable portion 58, the insulator 10 is pressed toward the first end side within the metallic shell 50 through the ring members 66 and 67 and the talc 69. As a result of this pressing, the talc 69 is compressed in the direction of the axial line O, and the airtightness of the metallic shell 50 is thereby improved.

Inside the metallic shell 50, an insulator step portion 15 of the insulator 10 that is located at the second end of the leg portion 13 is pressed against a metallic shell inner step portion 56 formed on the inner circumference of the mounting screw portion 52 through an annular sheet packing 68. The sheet packing 68 is a member for maintaining the airtightness between the metallic shell 50 and the insulator 10 and prevents the outflow of the combustion gas.

The center electrode 20 is a rod-shaped member including an electrode base metal 21 and a core 22 embedded therein. The core 22 has higher thermal conductivity than the electrode base metal 21. The electrode base metal 21 is formed of a nickel alloy containing nickel as a main component, and the core 22 is formed of copper or an alloy containing copper as a main component. A noble metal tip formed of, for example, an iridium alloy may be joined to the first end of the center electrode 20.

The center electrode 20 has a flange portion 23 protruding outward and formed near the second end thereof. The flange portion 23 is in contact, from the second end side, with an axial hole inner step portion 14 formed in the axial hole 12 to position the center electrode 20 within the insulator 10. The second end of the center electrode 20 is electrically connected to the metallic terminal 40 through a seal 64 and a ceramic resistor 63.

Figure 2:
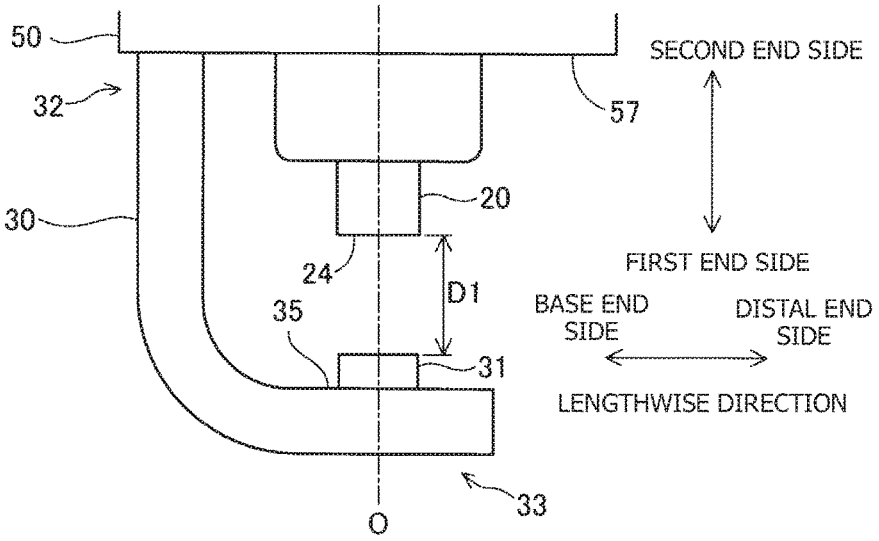
FIG. 2 is an enlarged side view around a ground electrode.

FIG. 2 is an enlarged side view around the ground electrode 30. In FIG. 2, the horizontal direction in the drawing sheet that is perpendicular to the axial line O is referred to as the "lengthwise direction" of the ground electrode 30. The right side of the drawing sheet is referred to as the "distal end side" of the ground electrode 30, and the left side of the drawing sheet is referred to as the "base end side" of the ground electrode 30. The ground electrode 30 is formed of an alloy containing nickel as a main component. The base end 32 of the ground electrode 30 is fixed to the end face 57 of the metallic shell 50. The ground electrode 30 extends from the base end 32 toward the first end side along the axial line O and is bent at an intermediate portion such that one side face of a distal end portion 33 of the ground electrode 30 faces an end face 24 of the center electrode 20. In the present embodiment, the end face 24 of the center electrode 20 has a perfect circular shape.

The ground electrode 30 has a tip-joining surface 35 facing the center electrode 20. A noble metal tip 31 is joined to the tip joining surface 35 so as to face the end face 24 of the center electrode 20 and to protrude toward the end face 24. In the present embodiment, the noble metal tip 31 is joined to the ground electrode 30 by resistance welding.

Figure 3:
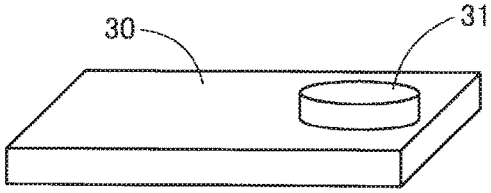
FIG. 3 is a schematic perspective view showing the shape of a noble metal tip.

FIG. 3 is a schematic perspective view showing the shape of the noble metal tip 31. As shown in FIG. 3, in the present embodiment, the noble metal tip 31 has an elliptic cylindrical shape.

Figure 4:
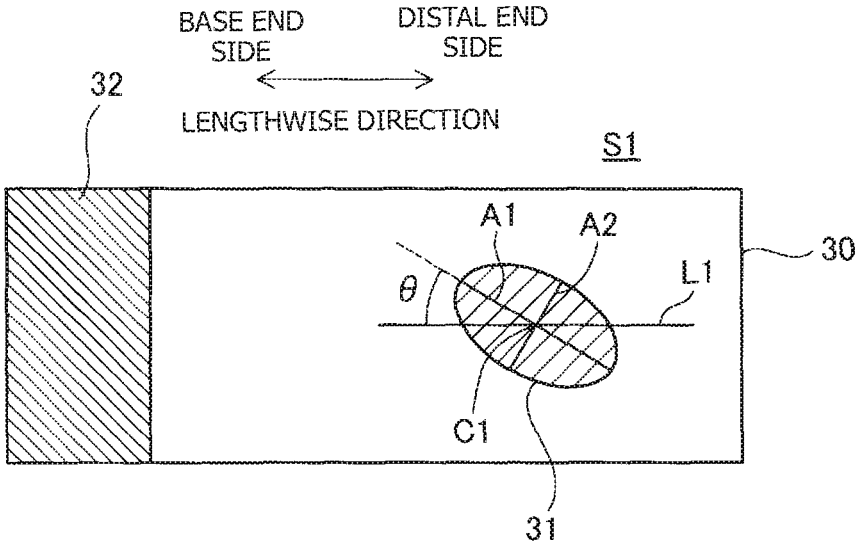
FIG. 4 is an illustration showing the direction of the major axis of the noble metal tip.

FIG. 4 is an illustration showing the direction of the major axis A1 of the noble metal tip 31. The drawing sheet of FIG. 4 is a plane (a projection plane S1) parallel to the tip-joining surface 35. In the present embodiment. When the noble metal tip 31 is projected onto the projection plane S1, the shape of the noble metal tip 31 in the projection plane 51 is elliptic. In the present embodiment, the major diameter of the noble metal tip 31 is 1.0 mm, and the minor diameter is 0.95 mm. In the present embodiment, the ellipse may be any substantially elliptical shape so long as its major axis can be identified. The ellipse may have some irregularities on its outer circumference or may have a flat portion.

Preferably, the angle θ between the major axis A1 of the ellipse and a straight line L1 extending along the lengthwise direction of the ground electrode 30 in the projection plane S1 is 45° or less. In the present embodiment, the angle θ is 0°. More specifically. When the ground electrode 30 is projected on the projection plane S1, the straight line L1 extends along the lengthwise direction of the ground electrode 30 and passes through the center C1 of the noble metal tip 31 in the projection plane S1.

Figure 5:
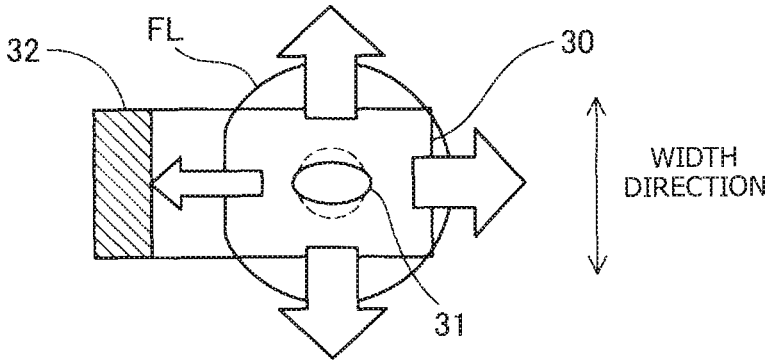
FIG. 5 is an illustration showing the expansion of a flame core when the ground electrode is viewed from the center electrode side.
Figure 6:
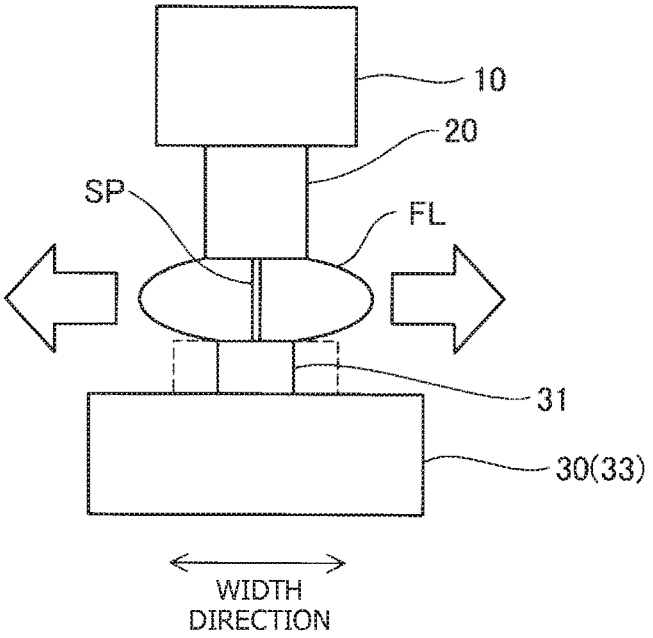
FIG. 6 is an illustration showing the expansion of the flame core when it is viewed from a distal end side of the ground electrode.

FIG. 5 is an illustration showing the expansion of a flame core FL when the ground electrode 30 is viewed from the center electrode 20 side. FIG. 6 is an illustration showing the expansion of the flame core FL when it is viewed from the distal end portion 33 side of the ground electrode 30. In the spark plug 100, when spark discharge is generated between the center electrode 20 and the ground electrode 30 (the noble metal tip 31), the spark SP (FIG. 6) causes an air-fuel mixture to ignite, and the flame core FL grows. In this case, as shown in FIG. 5, the flame core FL tends to expand in directions other than the direction toward the base end 32 of the ground electrode 30. This is because, in the direction toward the base end 32 of the ground electrode 30, the presence of the ground electrode 30 impedes the growth of the flame core. If the noble metal tip 31 is large as shown in FIG. 6 (see broken lines), the expansion of the flame core FL is impeded accordingly. However, in the present embodiment, the noble metal tip 31 has an elliptic cylindrical shape, and its major axis extends in the lengthwise direction of the ground electrode 30. Therefore, the width of the noble metal tip 31 in a direction different from the direction toward the base end 32 of the ground electrode 30 (i.e., the width direction of the ground electrode 30) is small, and this allows the flame core to more easily expand. As a result, the ignition performance of the spark plug 100 can be improved.

The noble metal tip 31 in the present embodiment has an elliptic cylindrical shape. Therefore, the surface area of the noble metal tip 31 can be smaller than the surface area of, for example, a cuboidal noble metal tip 31 having the same volume as the above noble metal tip 31. The quenching action is thereby restrained, and the ignition performance of the spark plug 100 is improved. Since the noble metal tip 31 in the present embodiment has an elliptic cylindrical shape, the volume of the noble metal tip 31 is larger than a perfect circular noble metal tip 31 having the same diameter as the minor diameter of the above noble metal tip 31, and therefore the durability is improved. In the present embodiment, while the durability of the spark plug 100 is ensured, its ignition performance can be improved.

In the above embodiment, it is preferable that the volume of the noble metal tip 31 is 0.15 $mm^3$ or more. When the volume of the noble metal tip 31 is 0.15 $mm^3$ or more, the possibility of the occurrence of misfiring can be lower than that when a noble metal tip having a shape different from the elliptic cylindrical shape is used. The reason for this will be described later on the basis of the results of a first test described later.

In the above embodiment, it is preferable that the ratio R of the length of the major axis A1 (the major diameter) of the noble metal tip 31 to the length of the minor axis A2 (the minor diameter) in the projection plane S1 shown in FIG. 4 is greater than 1.0 and less than 1.1. The ratio R is hereinafter referred to as a major diameter ratio R. When the major diameter ratio R is such a value, the joint strength of the noble metal tip 31 can be increased. The reason for this will be described later on the basis of the results of a second test described later.

In the above embodiment, it is preferable that the distance D1 between the noble metal tip 31 and the center electrode 20 (see FIG. 2, the distance D1 is hereinafter referred to as a "gap D1") is 1.3 mm or less. When the gap D1 is 1.3 mm or less, the possibility of the occurrence of misfiring can be lower than that when a noble metal tip having a shape other than the elliptical shape is used. The reason for this will be described later on the basis of the results of a third test.

Figure 7:
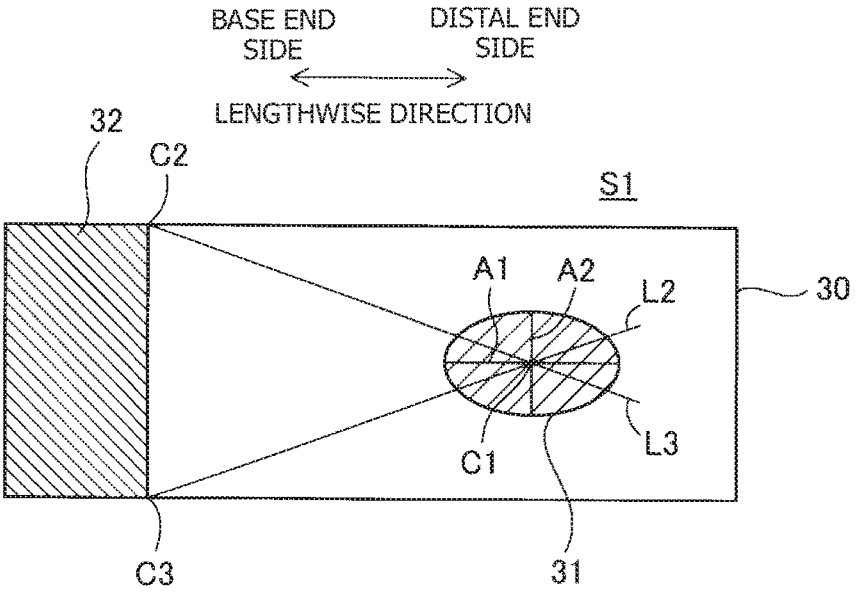
FIG. 7 is an illustration showing a preferred range of the direction of the major axis of the noble metal tip.

FIG. 7 is an illustration showing a preferred range of the direction of the major axis A1 of the noble metal tip 31. As shown in FIG. 7, in the above embodiment, in the projection plane S1 parallel to the tip-joining surface 35, the major axis A1 may be located between two straight lines L2 and L3 connecting the center C1 of the noble metal tip 31 to two corners C2 and C3 of the base end 32 that are on a side closer to the noble metal tip 31. When the major axis A1 of the noble metal tip 31 is located within the above range, the minor axis A2 of the noble metal tip 31 is not directed toward the base end 32 of the ground electrode 30. Therefore, it is possible to effectively prevent the expansion of the flame core from being impeded by the base end 32 of the ground electrode 30.

In the above embodiment, it is preferable that the major diameter of the noble metal tip 31 is smaller than the diameter of the end face 24 of the center electrode 20. When the major diameter of the noble metal tip 31 is smaller than the diameter of the end face 24 of the center electrode 20, it is possible to effectively prevent the expansion of the flame core from being impeded by the noble metal tip 31.

B. Results of Evaluation Tests

Figure 8:
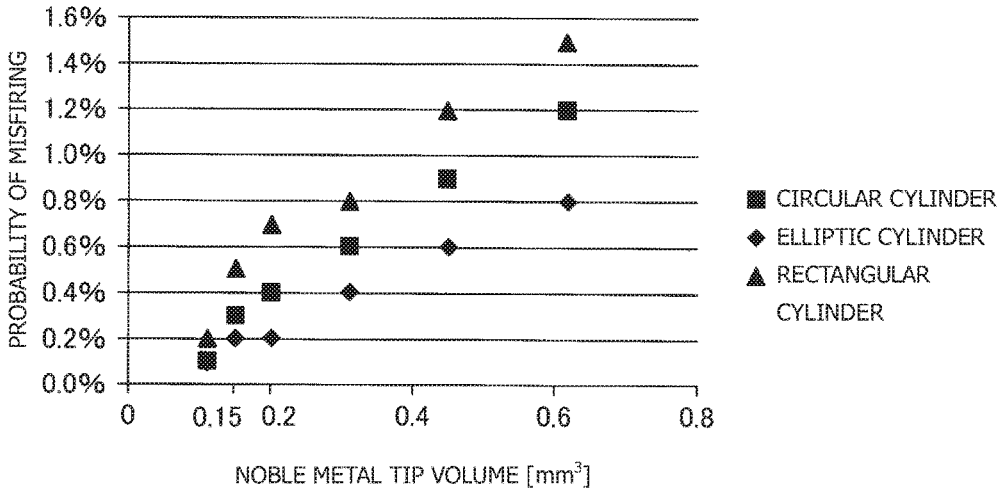
FIG. 8 is a graph showing the results of a first test for evaluating the relation between the volume of a noble metal tip and the probability of misfiring.

FIG. 8 is a graph showing the results of a first test for evaluating the relation between the volume of a noble metal tip and the probability of misfiring. In this test, a 2000 cc four-cylinder gasoline engine was operated at an engine rotation speed of 1,600 rpm and an ignition timing (BTDC)

of 30° with the number of times of ignition set to 30,000. Under such test conditions, the probability of misfiring was about 0.1% when a cylindrical noble metal tip with a volume of 0.11 $mm^3$ was used. The test was repeatedly performed using circular cylindrical, elliptic cylindrical, and rectangular cylindrical noble metal tips with different volumes so as to evaluate the probability of misfiring. The gap D1 between each noble metal tip and the center electrode was set to 0.6 mm. The major diameter ratio R of each elliptic cylindrical noble metal tip was set to 1.06, and the angle θ (see FIG. 4) was set to 0°.

As shown in FIG. 8, as the volume increases, the probability of misfiring increases, irrespective of the shape of the noble metal tip. This may be because, as the volume increases, the quenching action becomes strong, so that the growth of the flame core is impeded. When the volume was 0.15 $mm^3$ or more, the rate of increase in the probability of misfiring was significantly lower in elliptic cylindrical noble metal tips than in noble metal tips having other shapes. This may because, since the major axis of each noble metal tip extends in the lengthwise direction of the ground electrode, the width of the noble metal tip is small and the flame core can easily expand in the width direction of the ground electrode. Therefore, in above embodiment, it is preferable that the volume of the noble metal tip is 0.15 $mm^3$ or more. When the volume of the noble metal tip with an elliptic cylindrical shape meets this condition, the possibility of the occurrence of misfiring can be lower than that of noble metal tips having other shapes such as circular cylindrical and rectangular cylindrical shapes.

Figure 9:
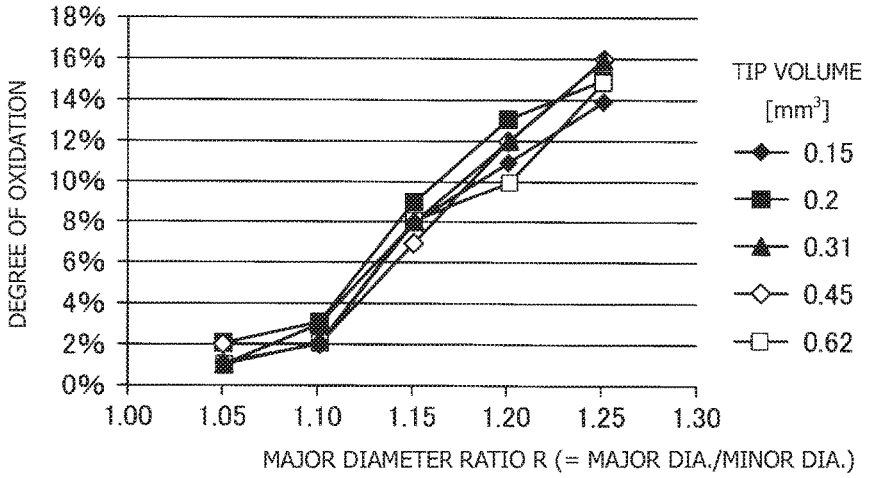
FIG. 9 is a graph showing the results of a second test for evaluating the relation between the major diameter ratio of a noble metal tip and the degree of oxidation.

FIG. 9 is a graph showing the results of a second test for evaluating the relation between the major diameter ratio R of a noble metal tip and the degree of oxidation. In this test, various noble metal tips with different volumes and different major diameter ratios were joined to ground electrodes. Each spark plug was heated for 2 minutes such that the temperature of the end face of the noble metal tip reached 1,000° C. and was then cooled for 2 minutes. This cycle was repeated 1,000 times. Then a half section of the welded portion between the noble metal tip and the ground electrode was obtained by cutting them along the minor axis of the noble metal tip. The ratio of the length of a crack to the length of the interface between the noble metal tip and the ground electrode in the half section was determined as the degree of oxidation.

As shown in FIG. 9, when the major diameter ratio R was larger than 1.1, the degree of oxidation was significantly large, irrespective of the volume of the noble metal tip. This may be because of the following reason. The noble metal tip expands and contracts according to its thermal expansion coefficient. When the major diameter ratio R is large, thermal stress acting in the major axis direction becomes large, and strain at the welding interface in the major axis direction becomes large, so that the weld strength decreases. Therefore, preferably; the major diameter ratio ft of the noble metal tip is more than 1.0 and less than 1.1. When the major diameter ratio R meets this condition, the joint strength of the noble metal tip can be increased.

Figure 10:
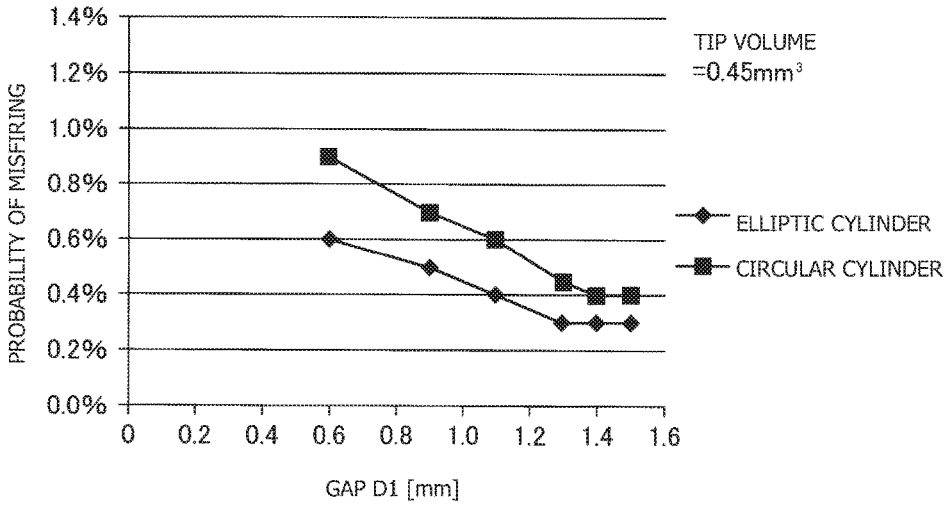
FIG. 10 is a graph showing the results of a third test for evaluating the relation between a gap and the probability of misfiring.
Figure 11:
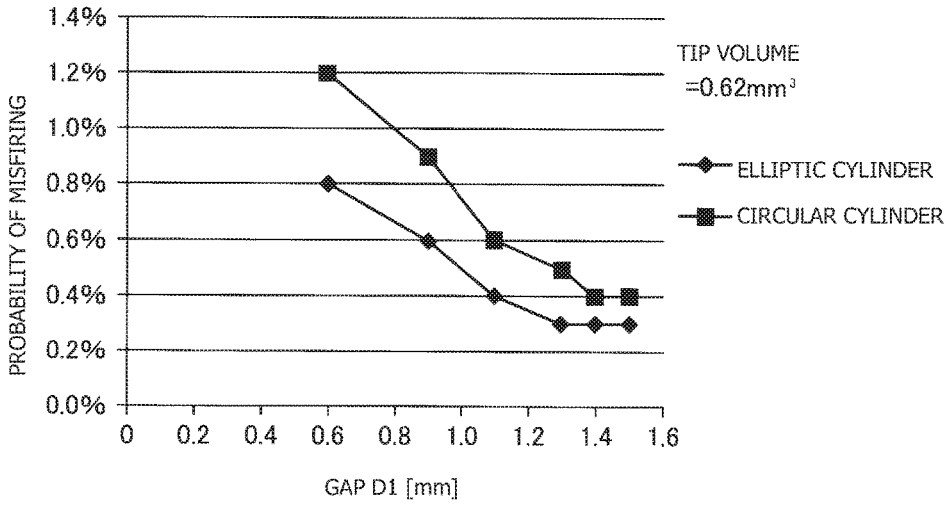
FIG. 11 is a graph showing the results of the third test for evaluating the relation between the gap and the probability of misfiring.

FIGS. 10 and 11 are graphs showing the results of a third test for evaluating the relation between the gap D1 and the probability of misfiring. FIG. 10 shows the test results when the volume of the noble metal tips used is 0.45 $mm^3$, and FIG. 11 shows the test results when the volume of the noble metal tips used is 0.62 $mm^3$. In this test, elliptic cylindrical noble metal tips and circular cylindrical noble metal tips were used for the evaluation. The same test method as in the first test was used.

As shown in FIGS. 10 and 11, the gap D1 was gradually reduced from 1.5 mm. When the gap D1 was 1.3 mm or less, the amount of increase in the probability of misfiring was smaller in the elliptic cylindrical noble metal tip than in the circular cylindrical noble metal tip. This may be because as the gap D1 decreases, the influence of the size of the noble metal tip (its size in the width direction of the ground electrode) on the expansion of the flame core becomes large. Therefore, it is preferable that the gap D1 is 1.3 mm or less. When the gap D1 meets this condition, the possibility of the occurrence of misfiring is smaller when the elliptic cylindrical noble metal tip is used than when noble metal tips having shapes other than the elliptic cylindrical shape are used.

C. Second Embodiment

Figure 12:
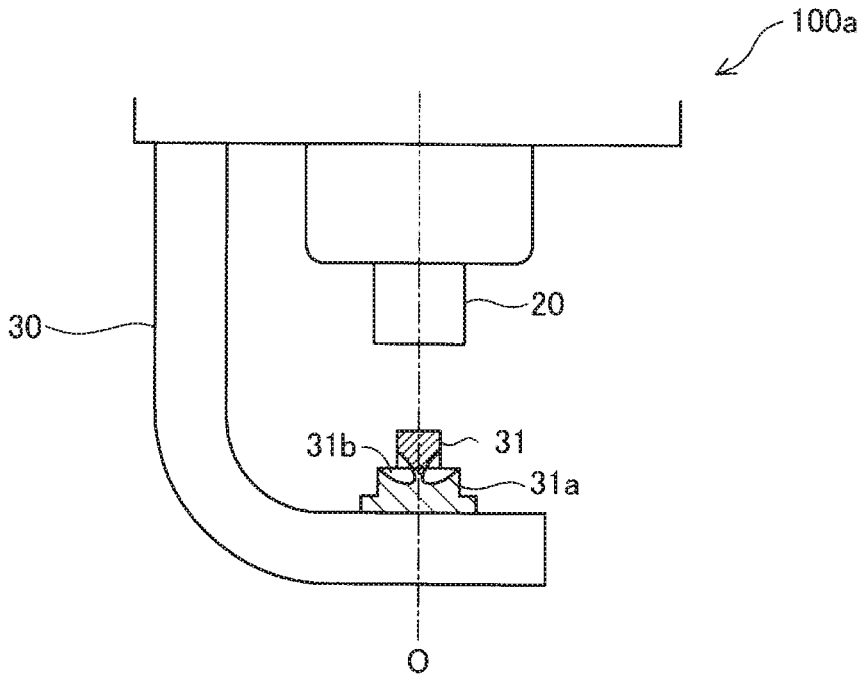
FIG. 12 is an illustration showing a spark plug according to a second embodiment of the present invention.

FIG. 12 is an illustration showing a spark plug according to a second embodiment of the present invention. In the second embodiment, the noble metal tip 31 is joined to the ground electrode 30 in a manner different from that in the first embodiment, and other components are the same as those in the first embodiment. In the second embodiment, an intermediate tip 31*a* is joined between the noble metal tip 31 and the ground electrode 30. The intermediate tip 31*a* is formed of the same material as the material of the ground electrode 30. The noble metal tip 31 and the intermediate tip 31*a* are laser-welded to each other, and the intermediate tip 31*a* and the ground electrode 30 are resistance-welded to each other.

Figure 13:
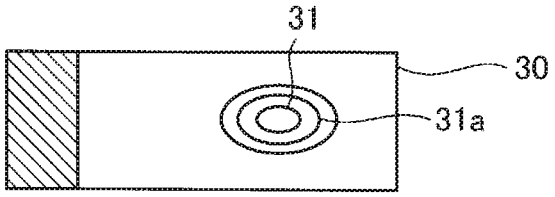
FIG. 13 is an illustration showing a noble metal tip in the second embodiment when it is viewed from the center electrode side.

FIG. 13 is an illustration showing the noble metal tip 31 in the second embodiment when it is viewed from the center electrode 20 side. In the second embodiment, as in the first embodiment, the noble metal tip 31 has an elliptic cylindrical shape. The intermediate tip 31*a* has an elliptic cylindrical shape having major and minor axes larger than those of the noble metal tip 31. The surface of the intermediate tip 31*a* that is joined to the ground electrode 30 has a flange shape.

In the spark plug 100*a* of the present embodiment, the noble metal tip 31 is joined to the ground electrode 30 through the intermediate tip 31*a* formed of the same material as the material of the ground electrode 30, and therefore the joint strength of the noble metal tip 31 joined to the ground electrode 30 can be improved. Even in the spark plug 100*a* having the above-described structure, the same effects as in the first embodiment are obtained because the noble metal tip 31 has an elliptic cylindrical shape. All the preferred conditions in the first embodiment are applicable to the second embodiment. The volume of the noble metal tip 31 in the present embodiment does not include the volume of a fused portion 31*b* (FIG. 12) between the noble metal tip 31 and the intermediate tip 31*a*.

The present invention is not limited to the above-described embodiments and may be embodied in various other forms without departing from the scope of the invention. For example, the technical features in the embodiments corresponding to the technical features in the modes described in "Summary of the Invention" can be appropriately replaced or combined in order to solve some of or all the foregoing problems or to achieve some of or all the foregoing effects. A technical feature which is not described as an essential feature in the present specification may be appropriately deleted.

DESCRIPTION OF REFERENCE NUMERALS

10: insulator
12: axial hole
13: leg portion

14: axial hole inner step portion
15: insulator step portion
17: first end-side trunk portion
18: second end-side trunk portion
19: central trunk portion
20: center electrode
21: electrode base metal
22: core
23: flange portion
24: end face
30: ground electrode
31: noble metal tip
31*a*: intermediate tip
32: base end
33: distal end portion
35: tip-joining surface
40: metallic terminal
50: metallic shell
51: tool engagement portion
52: mounting screw portion
53: crimp portion
54: seal portion
56: metallic shell inner step portion
57: end face
58: compression deformable portion
63: ceramic resistor
64: seal
65: gasket
66, 67: ring member
68: sheet packing
69: talc
100, 100*a*: spark plug
FL: flame core
S1: projection plane
SP: spark Having described the invention, the following is claimed:

1. A spark plug, comprising:

an insulator having an axial hole extending along an axial line;

a center electrode disposed within the axial hole;

a tubular metallic shell disposed around an outer circumference of the insulator; and a ground electrode having a tip-joining surface and a base end that is fixed to the tubular metallic shell, the ground electrode including a noble metal tip that is joined to the tip-joining surface via a fused portion so as to face an end face of the center electrode and to protrude toward the end face, the noble metal tip having an elliptic cylindrical shape, wherein, when the noble metal tip is projected onto a projection plane parallel to the tip-joining surface, the noble metal tip has an elliptical shape in the projection plane, and wherein, when the ground electrode is also projected onto the projection plane, an angle of 45° or less is formed between a major axis of the elliptical shape of the noble metal tip in the projection plane and a straight line that extends in a lengthwise direction of the ground electrode and passes through a center of the noble metal tip in the projection plane.

2. A spark plug according to claim 1, wherein the noble metal tip has a volume of 0.15 $mm^3$ or more.

3. A spark plug according to claim 1, wherein, in the projection plane, the ratio R of a major diameter of the elliptical shape to a minor diameter of the elliptical shape is greater than 1.0 and less than 1.1.

4. A spark plug according to claim 1, further comprising:

an intermediate tip joined between the noble metal tip and the ground electrode, the intermediate tip and the ground electrode being resistance-welded to each other.

5. A spark plug according to claim 1, wherein the distance between the noble metal tip and the center electrode is 1.3 mm or less.

6. A spark plug according to claim 1, wherein, in the projection plane, the major axis is located between two straight lines connecting a center of the elliptical shape to two corners of the base end that are on a side closer to the noble metal tip.

7. A spark plug according to claim 1, wherein the major diameter of the noble metal tip is smaller than a diameter of the end face of the center electrode.

8. A spark plug according to claim 4, wherein the intermediate tip has an elliptic cylindrical shape.

9. A spark plug according to claim 4, wherein portions of the noble metal tip are fused to the intermediate tip via the fused portion.

* * * * *